US005497520A

United States Patent [19]

Kunz et al.

[11] Patent Number: 5,497,520

[45] Date of Patent: Mar. 12, 1996

[54] INFLATABLE LEG AND FOOT SUPPORT

[76] Inventors: Richard D. Kunz, 6667 S. 300 West, #4, Murray, Utah 84107; Dale O. Kelsch, 2657 E. Willowbend, Sandy, Utah 84093; Lamar C. Beynon, 168 S. 300 East, Washington, Utah 84780

[21] Appl. No.: 272,562

[22] Filed: Jul. 11, 1994

[51] Int. Cl.[6] ..... A47C 20/02; A47G 9/00

[52] U.S. Cl. ..... 5/648; 5/449; 5/644

[58] Field of Search ..... 5/453, 654, 449, 5/454, 455, 644, 650, 648, 456; 297/DIG. 3

[56] References Cited

U.S. PATENT DOCUMENTS

| | | | |
|---|---|---|---|
| 3,251,075 | 5/1966 | Saltness et al. | 5/644 |
| 3,303,518 | 2/1967 | Ingram | 5/456 |
| 3,308,489 | 3/1967 | Winkler | 5/644 |
| 3,533,113 | 10/1970 | Stamberger | 5/654 |
| 4,394,784 | 7/1983 | Swenson et al. | 5/453 |
| 5,113,875 | 5/1992 | Bennett | 5/648 |
| 5,173,979 | 12/1992 | Nennhaus | 5/648 |
| 5,184,365 | 2/1993 | Stafford | 5/644 |

FOREIGN PATENT DOCUMENTS

| | | | |
|---|---|---|---|
| 2106779 | 4/1983 | United Kingdom | 5/654 |

*Primary Examiner*—Alexander Grosz
*Attorney, Agent, or Firm*—J. David Nelson

[57] ABSTRACT

An inflatable support for selectively supporting a persons's feet and legs comprises an air bag having a semi-tubular top panel, an essentially flat bottom panel, and side panels that are "hinged" together at collapse joints in a manner to fold together to permit the top panel to collapse downwardly against the bottom panel. The side panels fold inwardly toward one another in an accordion-like fashion to permit essentially full collapse of the foot and leg support to a thickness of only that of the combined thicknesses of rubber material, of which the support is constructed. A remote compressed air source communicates with an inflation valve to inflate the foot and leg support, and a second deflation valve exhausts the pressurized air within the air bag to atmosphere. A remote control unit permits the user to activate the inflation and deflation valves to inflate/deflate the air bag to raise/lower the user's feet and legs as desired.

6 Claims, 2 Drawing Sheets

INFLATABLE LEG AND FOOT SUPPORT

FIELD OF THE INVENTION

This invention relates to an inflatable cushion for positioning and support of the legs and feet, and in particular, inflatable devices for the positioning and support of the feet and legs of a person while in bed or otherwise in a supine position.

BACKGROUND OF THE INVENTION

Various devices for positioning, support and comfort of the feet and legs are well known. Cushions, including inflatable cushions such as disclosed in U.S. Pat. No. 4,979,249 to Meade, U.S. Pat. No. 4,768,247 to Beier, U.S. Pat. No. 4,161,794 to Darnfors, U.S. Pat. No. 4,142,263 to Pierson and U.S. Pat. No. 4,133,064 to Petrusek disclose inflatable means for the support and comfort of various parts of the body of a person in the supine position. Various types of such pillows and cushions, both inflatable and non-inflatable, are regularly utilized in institutional settings such as hospitals and nursing homes. Also, well known are mechanical devices for positioning the legs and feet which are frequently incorporated into a mechanized hospital bed.

An inflatable fixed support device is disclosed in U.S. Pat. No. 3,803,645 to Oliverius. This device is not well suited for the positioning, support and comfort of the legs, and would not allow for the positioning of the legs at various heights above the surface of the bed. Further, it cannot be deflated to a compact position beneath the legs.

Accordingly, there is a need for an economical, adjustable support for the legs and feet that is comfortable at all degrees of inflation. An object of the present invention is to provide a economical and adjustable leg and foot support for use by a person in bed or in a supine position.

Another object of the present invention is to provide an inflatable foot and leg support which predictably is comfortable to a user at all degrees of inflation.

A further objective of the present invention is to provide an inflatable leg and foot support which would deflate to a compact and flat configuration which is non intrusive to the user.

Another still further objective of the present invention is to provide a leg and foot support which is economical in comparison to mechanical devices for supporting the legs and feet.

Another still further objective of the present invention is to provide a leg and foot support that is easy to operate, can be operated from the position of use, and is easy to maintain and repair.

SUMMARY OF THE INVENTION

The present invention provides an inflatable leg and foot support which is of simplified and economical construction, which is readily portable and transferrable to multiple use locations, which is adjustable to various heights, and which is comfortable to a user for all degrees of inflation, including complete deflation.

The present invention comprises: (1) an inflatable air bag which assumes a semi-tubular shape when inflated and which is rounded on the top and flat on the bottom, and which tents together in the middle, (2) a source of pressurized air, and (3) a means for controllably inflating and deflating the air bag. The top surface of the bag is soft rubber for the comfort of the user; the bottom panel and the side panels of the bag are constructed of heavy duty rubber. The side panels are connected to the bottom and top respectively with soft rubber collapse joints, and a soft rubber collapse joint runs lengthwise approximately in the middle of the side panels on each side. The end panels are constructed of soft rubber and the widths of the end panels are pinched in the middle, thereby directing the collapse of the bag as it is deflated, and effecting compact deflation of the bag as it is totally deflated.

The air bag has a coupling for connecting an air hose from the pressurized air source. The air hose communicates with two valves, one for controlling inflation of the bag, and the other for controlling deflation of the bag. Each valve is electrically or pneumatically controlled by a switch or button.

To use the invention, the user or an assisting person actuates the inflation switch which opens the inflation valve line of air into the bag. The inflation air valve is retained open until the desired amount of air has entered the bag, thereby achieving a desired degree of inflation. The degree of inflation may subsequently be increased by opening the inflation valve or decreased by opening the deflation valve. When support is no longer desired, the bag is completely deflated by opening the deflation valve until the air is completely evacuated from the bag and the bag has assumed its compact, deflated, and collapsed configuration.

The invention offers advantages over known devices in its simplified and economical construction, its ease of operation and maintenance, its adjustability, its comfort and its portability.

DETAILED DESCRIPTION OF THE PREFERRED EMBODIMENTS

Figure 1:
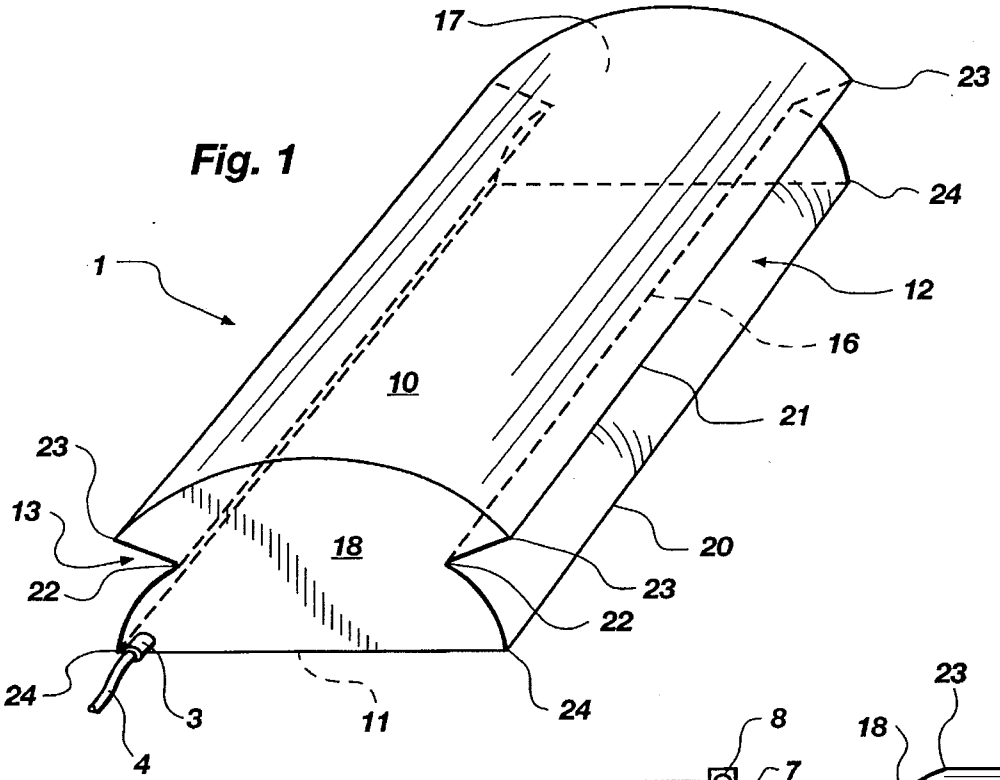
FIG. 1: A perspective view of the leg and foot support in its fully inflated configuration.
Figure 2:
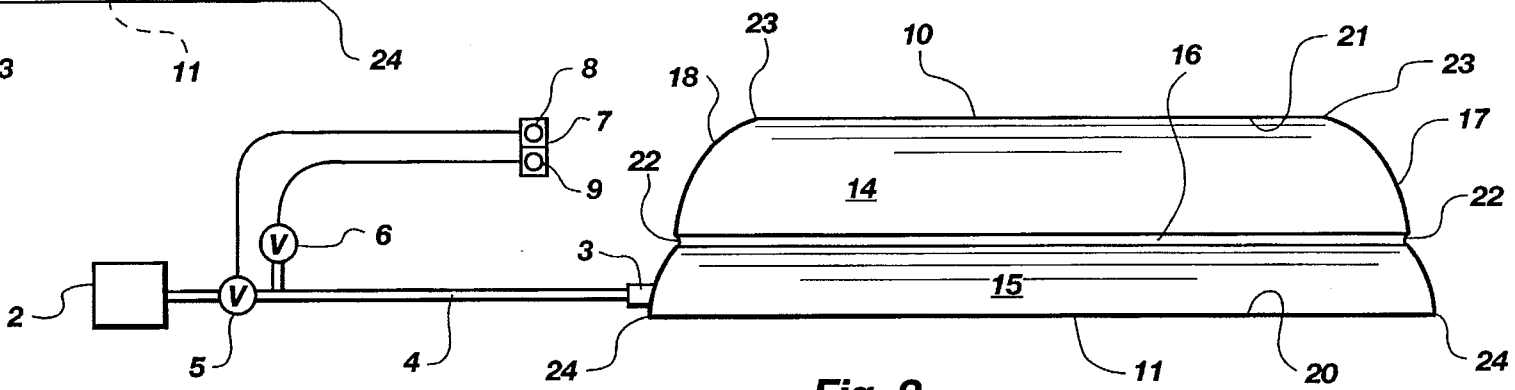
FIG. 2: A side elevation of the leg and foot support, also illustrating the inflating and deflating mechanism.

Referring first to FIGS. 1 and 2, a preferred embodiment of an inflatable leg and foot support comprises an inflatable air bag 1 connected to a pressurized air source 2 by means of an air supply coupling 3 and air supply hose 4, and an inflation valve 5 for the air source 2. Deflation is accomplished through the same air supply coupling 3 and hose 4, which is also connected to a deflation valve 6. A control unit 7 actuates both the inflation and deflation valves 5 and 6, and is remote therefrom so that the user may keep it by his side. The control unit includes an inflation switch or button 8 and a deflation switch or button 9.

The air bag 1 is roughly in the shape of a tube which has a round top panel 10, a flat bottom panel 11, two sidewalls 12 and 13, which have top and bottom panels 14 and 15 flexibly connected in the middle by first soft rubber collapse joints 16. Two end panels 17 and 18 connect to the top and bottom panels, and to both sidewalls to define the airtight inflatable air bag 1.

In a preferred embodiment, the top panel 10 and end panels 17 and 18 are constructed of soft rubber, and the bottom panel 11 and sidewall panels 14 and 15 are constructed of heavy duty rubber. The top sidewall panels 14 of each sidewall 12 and 13 are connected to respective bottom sidewall panels 15 of each sidewall 12 and 13 with the first soft rubber collapse joints 16, thereby providing flexible joints between the top and bottom panels of the sidewalls 12 and 13. Each bottom sidewall panel 15 is flexibly connected to the bottom panel 11 by a respective second soft rubber collapse joint 20. Respective third soft rubber collapse joints 21 connect respective top sidewall panels 14 to the top panel 13.

Referring to FIG. 2, in a preferred embodiment of the invention, the air supply coupling 3, which is presently located on an end panel 17 is connected to the air supply hose 4. Air is introduced into the air bag 1 by the user's actuating the control unit inflation switch 8 which opens the inflation valve 5, thereby allowing air to flow through the air hose 4 into the air bag 1. When the air bag 1 has achieved the desired inflation, the user releases the control unit inflation switch 8 to close the inflation valve 5, shutting off the supply of air to the air bag 1.

When deflation of the leg and foot support to a less inflated configuration is desired, the user actuates the control unit deflation switch 9 to open the deflation valve 6, which is connected by the air supply hose 4 to the end panel 17 of the air bag 1. Opening the deflation valve 6 permits pressurized air to escape from the air bag through the valve to atmosphere. When the desired deflation has been accomplished, the user releases the control unit deflation switch 9, closing the deflation valve 6, thereby stopping the flow of air from the air bag 1.

The air control unit 7 has been described in terms of a switch or button. It should be apparent to those skilled in the art that the control unit can be mechanical, electrical, or pneumatic. It can also be wireless electrical. It should also be apparent that the control unit can be adjustable, in terms of controlling the amount the respective air valves open, to therefore control the rate at which the air bag is inflated and deflated.

Repetitive and predictable collapse of the leg and foot support during deflation is accomplished by the soft rubber collapse joints 16 between the sidewall top and bottom panels 14 and 15, respective second collapse joints 20 between the bottom panel 11 and the sidewall lower panel 15, and respecting third collapse joints 21 between the top sidewall panel 14 and the top panel 10.

In a preferred embodiment of the invention, the widths of the end panels 17 and 18 at the points 22 that the soft rubber collapse joints 16 between the sidewall top and bottom panels 14 and 15 connect to the end panels is less than the widths of the end panels at the points 23 that they connect to the top panel 10 and the points 24 that they connect to the bottom panel 11. This induces the predictable and repetitive folding of the sidewall panels 14 and 15 with the top panel 14 of each sidewall 12 resting on the bottom panel 15 of each sidewall when the bag is deflated. This results in the compact cross-section as shown in FIG. 4, the air bag 1 in its fully deflated configuration.

Figure 4:
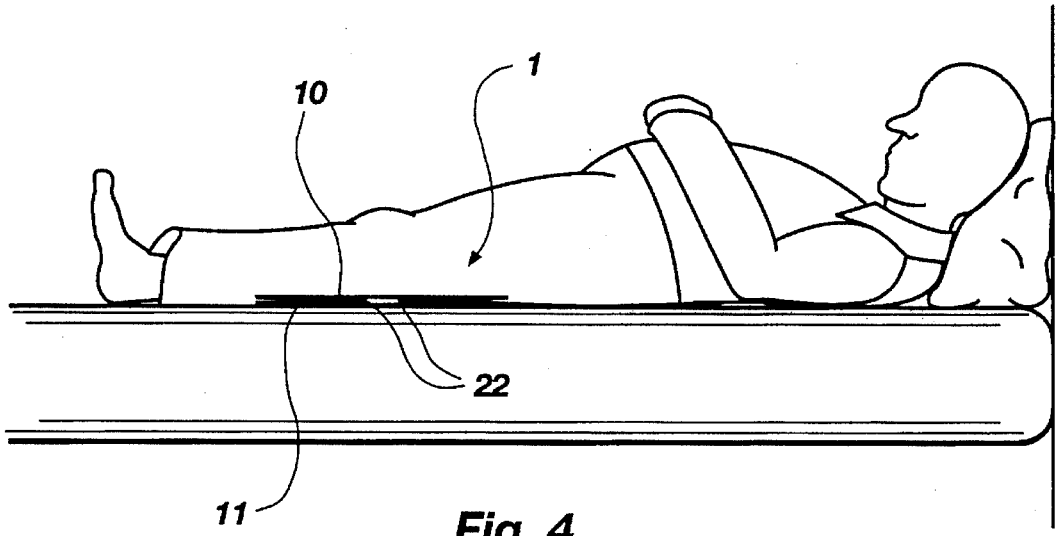
FIG. 4: An end view of the leg and foot support in its fully deflated configuration shown in use by a user.

In use, it will be presumed that the inflatable leg and foot support of the present invention is in its deflated, collapsed configuration, as is shown in FIG. 4, and is positioned essentially under the feet, lower leg, knees, as desired, of the user in a supine position laying on a bed, for instance. To raise his feet and lower legs, the user actuates the air supply control unit inflation switch 8 which: (1) supplies electrical power to the motor of the source of pressurized air 2, and (2) opens the air supply inflation valve 5, to thereby supply pressurized air from the source 2, through the air supply hose 4 and coupling 3, and into the interior of the inflatable air bag 1 to inflate same to the desired amount of inflation. This presupposes, of course, that the deflation valve 6 and control unit deflation switch 8 are not activated, and that the deflation valve is closed to prevent inadvertent escape of pressurized air from the interior of the air bag as the air bag is being pressurized via the source of pressurized air 2.

The user maintains his actuation of the air supply inflation switch 8 to cause the source of pressurized air 2 to fill the interior of the inflatable air bag 1 to the desired amount of inflation. When this desired inflation amount has been reached, the user simply releases the inflation switch 8, which: (1) closes the air supply inflation valve 5 to seal the interior of the inflatable air bag 1 against inadvertent escape of the pressurized air therethrough, and (2) interrupts the electrical power to the pressurized air source.

Frequently during use, the user desires to either increase or decrease the amount of pressurized air within the inflatable air bag 1. In other words, the user wants to raise or lower the inflatable leg support, and therefore his feet and lower legs. To further inflate the leg support air bag 1, and therefore to further raise his feet and legs from the bed surface, the user simply again actuates the air supply control unit inflation switch 8, which, as previously described, introduces pressurized air from the air source 2 through the air supply hose 4 and into the interior of the inflatable bag 1. The user again maintains the inflation switch 8 in its "fill" or "raise" position until the inflatable leg support has raised his feet and lower legs to the desired position.

Likewise, to lower his feet and lower legs, the user releases some of the pressurized air from the air bag interior by actuating the control unit deflation switch 9, which opens the deflation valve 6 to effect a controlled release of pressurized air from within the air bag to atmosphere. When the inflatable leg support has reached the desired position of inflation (i.e., when the user's feet and lower legs have reached his desired position relative to the bed's surface), the user simply releases the deflation switch 9, which interrupts the outflow of pressurized air through the deflation valve 6 to atmosphere. The remaining pressurized air within the inflatable air bag 1 will now cause the air bag to retain the user's feet and lower legs in the desired position until the user again adjusts this position by raising or lowering the inflatable leg support, i.e., by further pressurization of the air bag or releasing of some of the pressurized air within the air bag.

Figure 3:
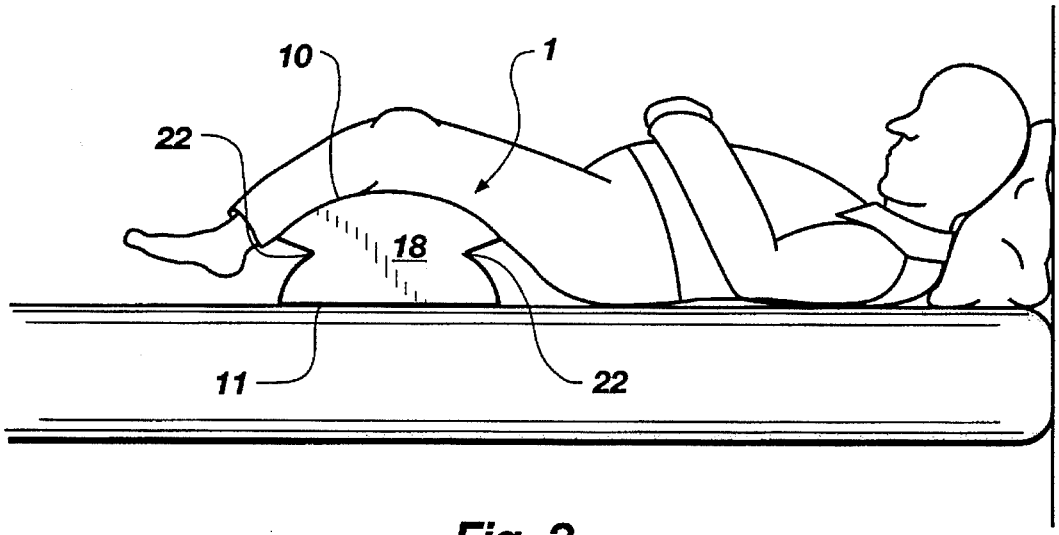
FIG. 3: An end view of the leg and foot support in a fully inflated configuration demonstrating a potential use of the leg and foot support.

It should be apparent, therefore, that the user may evacuate all of the air from within the air bag 1 by actuating the deflation switch 9 until the air bag is completely evacuated, and assumes its collapsed orientation, as shown in FIG. 4. It should also be apparent that the system of soft rubber collapse joints 16, 20 and 21 enables the curved top panel 10 to drop directly against the bottom panel 11 (vertically as shown in the drawings) each time the inflatable leg support is deflated to its collapsed position. This is accomplished, of course, because the system of soft rubber collapse joints is symmetric about a longitudinal center line of the device. Specifically, as the leg support collapses, the narrower widths of the end panels 17 and 18 at their respective connection points 22 with respective first collapse joints 16 draw the two opposite first soft rubber collapse joints 16 directly toward each other as both top and bottom sidewall panels 14 and 15 fold inwardly relative to the top panel 10 and bottom panel 11, respectively, and toward each other. This enables the inflatable leg support to fully collapse from its inflated position as shown in FIGS. 1–3 to an essentially flat configuration as shown in FIG. 4.

Other embodiments of the invention and other variations and modifications of the embodiments described above would be obvious to a person skilled in the art. Therefore, the foregoing is intended to be merely illustrative of the invention and the invention is limited only by the following claims.

What is claimed is:

1. An inflatable leg and foot support, comprising:

(a) an air bag comprising:

a top panel having two opposed long edges and two opposed short edges;

a bottom panel having two opposed long edges and two opposed short edges;

two sidewalls connected to the top and bottom panels by respective soft rubber collapse joints along respective long edges thereof, each sidewall comprising an upper panel and a lower panel, each sidewall panel having two opposed long edges and two opposed short edges, one long edge of each sidewall panel being connected together by a soft rubber collapse joint, the other long edge of each sidewall panel being connected to a respective air bag top and bottom panel by respective soft rubber collapse joints; and two flexible end panels, each connected to a respective air bag top panel short edge, air bag bottom panel short edge, and two sidewall panel short edges;

the air bag top panel short edges and sidewall lower panel short edges being arcuate, and the air bag bottom panel short edges and sidewall upper panel short edges being straight, when the air bag is inflated; and (b) inflating and deflating means for controlled inflation and deflation of the air bag, the inflating and deflating means comprising:

a pressurized air source;

an air supply hose connecting the pressurized air source and the air bag;

an inflation valve disposed in the air supply hose;

a deflation valve disposed in the air supply hose; and control means connected to the inflation and deflation valves for controlling inflation and deflation of the air bag.

2. An inflatable leg and foot support as set forth in claim 1, wherein said bottom panel and said sidewall panels are constructed of a heavy duty rubber material.

3. An inflatable leg and foot support as set forth in claim 1, wherein said top panel and end panels are constructed of a soft rubber material.

4. An inflatable leg and foot support as set forth in claim 1, wherein said top panel is semi-cylindrical in shape.

5. An inflatable leg and foot support as set forth in claim 1, wherein the inflating and deflating means is user-adjustable.

6. An inflatable leg and foot support as set forth in claim 1, wherein the inflation valve and deflation valve are operational independently of each other.

* * * * *